US007261520B2

(12) United States Patent
Wang

(10) Patent No.: US 7,261,520 B2
(45) Date of Patent: Aug. 28, 2007

(54) HANGER ASSEMBLY FOR CEILING FAN

(75) Inventor: Cliff Wang, Taichung (TW)

(73) Assignee: Air Cool Industrial Co., Ltd., Taichung (TW)

( * ) Notice: Subject to any disclaimer, the term of this patent is extended or adjusted under 35 U.S.C. 154(b) by 195 days.

(21) Appl. No.: 11/130,524

(22) Filed: May 17, 2005

(65) Prior Publication Data

US 2006/0263224 A1 Nov. 23, 2006

(51) Int. Cl.
*F04D 29/64* (2006.01)

(52) U.S. Cl. ..... 416/244 R; 248/343

(58) Field of Classification Search ..... 416/244 R; 248/343

See application file for complete search history.

(56) References Cited

U.S. PATENT DOCUMENTS 5,613,832 A * 3/1997 Su ..... 416/244 R
6,010,110 A * 1/2000 Bucher et al. ..... 248/694
6,439,527 B1 * 8/2002 Lin ..... 248/343
6,790,008 B1 * 9/2004 Huang ..... 416/244 R
6,877,703 B2 * 4/2005 Tang ..... 248/342

* cited by examiner

*Primary Examiner*—Edward K. Look
*Assistant Examiner*—Devin Hanan
(74) *Attorney, Agent, or Firm*—Parsons & Goltry; Michael W. Goltry; Robert A. Parsons

(57) ABSTRACT

A hanger assembly for depending a ceiling fan from a overhead includes a hanger bracket securable a support member integral with the overhead. A down rod suspended from the hanger bracket has a lower end adapted for engagement with the ceiling fan. A canopy has a central opening through which the down rod is received and an upper rim which receives the sidewall of the hanger bracket. The upper rim of the canopy is secured to the hanger bracket by a plurality of screws having heads exposed on the outside of the upper rim of the canopy. A rim cover which fits over and encapsulates the screw heads is engagable with the canopy in snap engagement.

5 Claims, 5 Drawing Sheets

10
12
13
14
15
17
18
19
20
22
23
24
27
28
29
30
32
35
37
38
40
43
44
45
47
48

HANGER ASSEMBLY FOR CEILING FAN

BACKGROUND OF THE INVENTION

1. Field of the Invention

This invention relates to ceiling fans.

More particularly, the present invention relates to hanger assemblies for depending a ceiling fan from an overhead support device.

In a further and more specific aspect, the instant invention concerns an aesthetically enhanced hanger bracket of the above type.

2. The Prior Art

Ceiling fans are conventionally suspended from a ceiling by means of a hanger assembly. A known hanger assembly includes a hanger bracket securable to an overhead support member such as an electrical junction box. The hanger bracket includes slots which receive screws there through for engagement with the flanges of the junction box.

A ball socket is formed into the top of the hanger bracket. A ball, supported in the ball socket for swivel motion, supports a depending down rod. Attachment means, integral with the lower end of the down rod, are secured to the fan. A canopy, generally in the shape of an inverted dome, includes a central opening through which the down rod passes and an upper rim which encircles the peripheral sidewall of the hanger bracket.

The rim of the canopy is secured to the hanger bracket by means of a plurality of screws which extend through openings in the rim of the canopy and threadedly engage within the hanger bracket. The heads of the screws reside external of the canopy.

It is recognized that the exposed screw heads detract from the aesthetics of the hanger assembly. Accordingly, the prior art has provided a rim cover which encapsulates the screw heads. In accordance with one embodiment, the prior art has provided a rim cover having a plurality of J-shaped recesses formed into the inside surface which receive the heads of the screws. In accordance with another embodiment, the rim cover is fabricated of a resilient material. An annular groove formed in the inner surface of the resilient cover receives the screw heads in snap engagement.

While encasing the screw heads, the rim covers provided by the prior art have not proven to be entirely satisfactory. Forming a J-shaped groove into the inner surface of the rim cover requires that the rim cover be extraordinarily thick. Also forming such grooves requires extraneous and relatively expensive manufacturing. Fabricating the rim cover of a resilient material detracts from the desired aesthetics. It is also noted that the screw heads tend to be relatively small with rounded exposed surfaces which do not adequately engage the prior art rim covers.

It would be highly advantageous, therefore, to remedy the foregoing and other deficiencies inherent in the prior art.

SUMMARY OF THE INVENTION

The above problems and others are at least partially solved and the above objects and others realized in a hanger assembly including a hanger bracket having a peripheral sidewall and securable to an overhead support member which is integral with a ceiling. A down rod having a lower end engagable with a fan is suspended from the hanger bracket. A canopy having an opening for receiving the down rod there through includes an upper rim for receiving the sidewall of the hanger bracket therein.

A plurality of mounting screws secures the canopy to the hanger bracket. Each screw extends through a respective opening in the rim of the canopy and is engaged within the hanger bracket. Each screw includes a head residing external of the rim of the canopy. Next provided is a rim cover for encapsulating the heads of the screws and securable to the rim of the canopy.

Preferably, the rim cover is received by the rim of the canopy in snap engagement. An element of a detent engagement pair is carried by the rim of the canopy and a complemental element of the detent engagement pair is carried by the rim cover for detachable engagement with the element carried by the canopy. More specifically, one of the element or complemental element of the detent engagement pair includes an indentation. The other of the element and complemental element of the detent engagement pair includes a protrusion matingly receivable within the indentation.

In accordance with a preferred embodiment of the present invention, the indention is formed into the upper rim of the canopy and the protrusion extends inwardly from the rim cover. Further the protrusion is resilient.

In one embodiment, the protrusion is carried by a base affixed to the rim cover. In another embodiment, there is a finger having a lower end affixed to the rim cover and an opposing upper end, a front face and an opposing rear face. There is a gap between the rear face of the finger and the rim cover. The finger is flexurally resilient in reciprocal directions relative to the rim cover, and the protrusion the protrusion is carried by the front face of the finger.

The rim cover includes an upper edge which is receivable in juxtaposition with the ceiling. The rim cover further includes an in turned lower edge which is received in juxtaposition with the canopy.

BRIEF DESCRIPTION OF THE DRAWINGS

The objects and advantages of the instant invention will become readily apparent to those skilled in the art from the following detailed description of a preferred embodiment thereof taken in conjunction with the drawings in which.

DETAILED DESCRIPTION OF A PREFERRED EMBODIMENT

Figure 1:
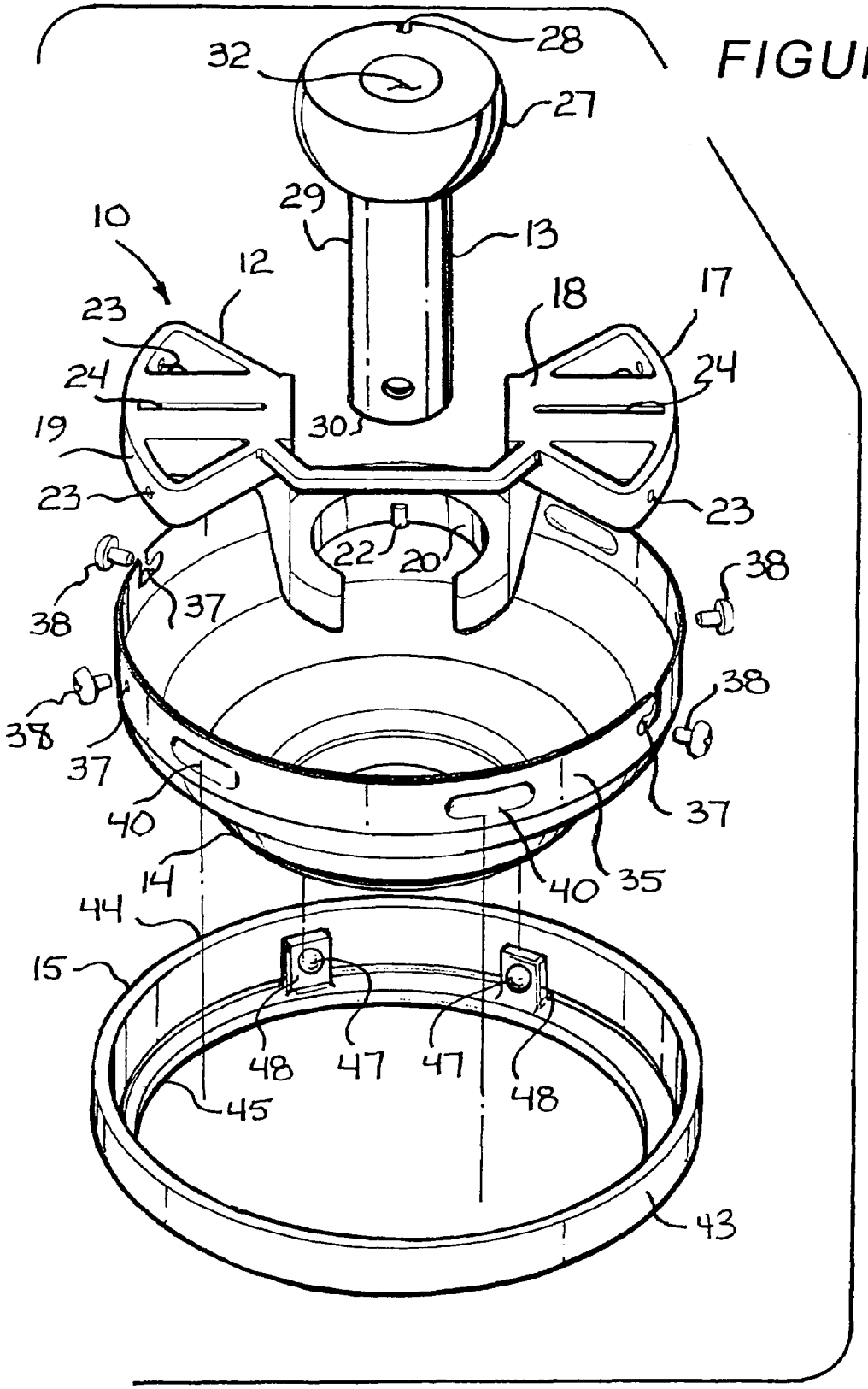
FIG. 1 is an exploded perspective view of a ceiling fan hanger assembly constructed in accordance with the principles of the instant invention.

Turning now to the drawings, in which like reference characters indicate corresponding elements throughout the several views, attention is first directed to FIG. 1 in which is seen a ceiling fan hanger assembly, incorporating the teachings of the instant invention and generally designated by reference character 10. Hanger assembly 10 comprises hanger bracket 12, down rod 13, canopy 14 and rim cover 15.

Hanger bracket 12 includes base 17, upper surface 18 and peripheral sidewall 19. Spherical ball socket 20 is formed into bracket 12 at a generally central location. Key 22 projects radially inward from ball socket 20. Threaded bores 23 extend into base 17 from peripheral sidewall 19.

Slots 24 extending through base 17 accommodate mounting screws which pass through the slots 22 and threadedly engage an overhead support member. Although the overhead support member is not specifically illustrated, those skilled in the art will readily appreciate that conventional overhead support members include electrical junction boxes, especially devised struts and beams, all of which are considered to be integral with a ceiling. Further, when hanger bracket 12 is secured to the overhead support member, upper surface 18 abuts the ceiling.

Figure 2:
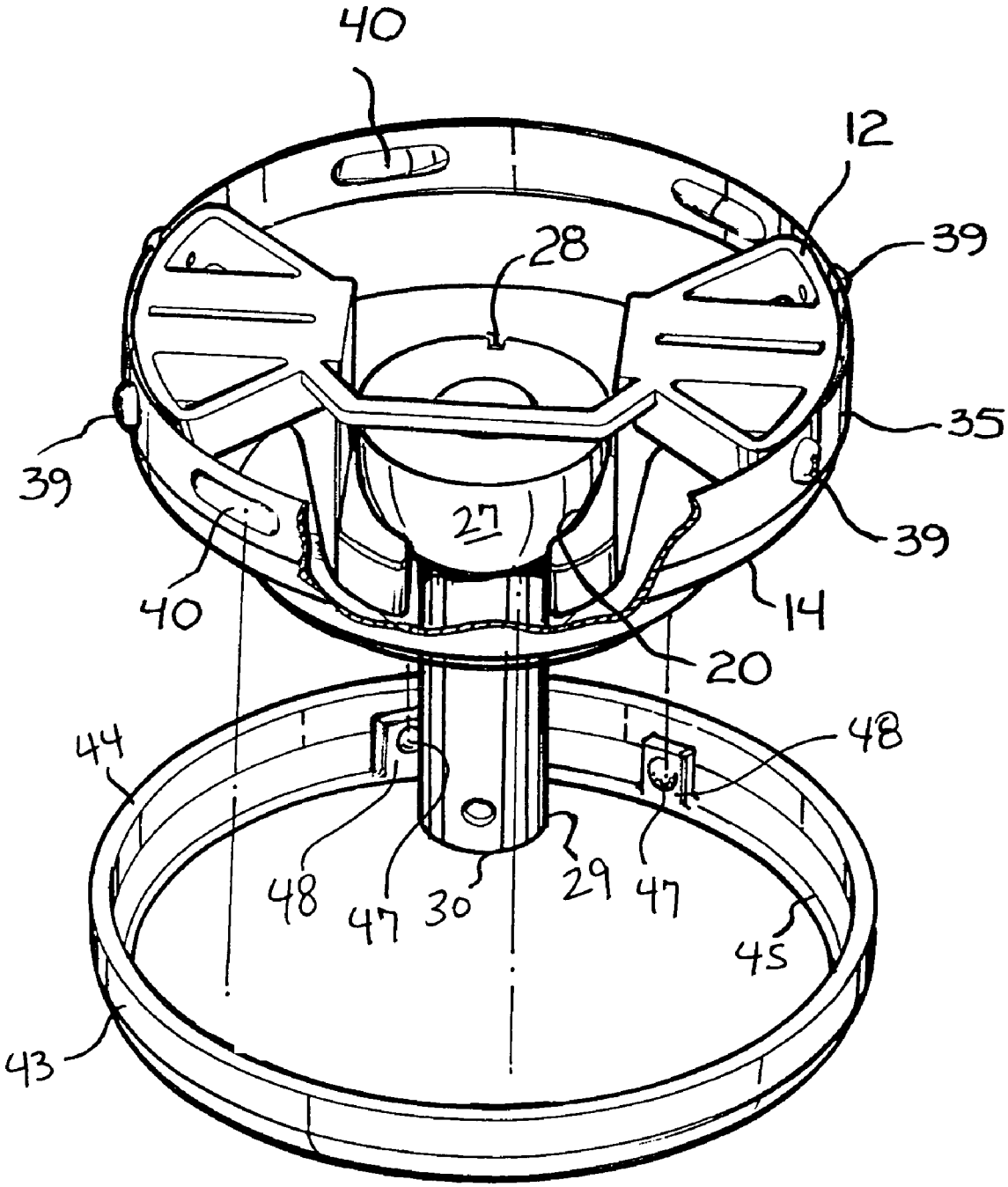
FIG. 2 a partially exploded perspective view showing the fan assembly in an intermediate stage of assembly.

As seen with further reference to FIG. 2, down rod 13 comprises ball 27 which is matingly received within spherical socket 20. Key 22 is engaged within keyway 28 formed into ball 27. Shaft 29, having lower end 30, depends from ball 27. It will be readily understood by those skilled in the art that the lower terminal portion of shaft 28 adjacent lower end 30 can be threaded or otherwise configured for securement to a conventional ceiling fan. Bore 32 extending longitudinally through ball 27 and shaft 29 accommodate the electrical wires which extend from a junction box to the fan.

Canopy 14, generally in the shape of an inverted dome as illustrated in FIG. 1 and FIG. 2, includes a generally central opening 34 for receiving shaft 29 there through. Canopy 14 also includes an upper rim 35 sized and shaped to receive peripheral sidewall 19 of hanger bracket 12 therein.

A plurality of openings 37 extend through upper rim 35 of canopy 14. Openings 37 are spaced to align with the threaded bores 23 in hanger bracket 12. A screw 38 extends through each opening 37 and threadedly engaged with a respective threaded bore 23 in peripheral sidewall 19 of hanger bracket 12. A particularly noted in FIG. 2, the head 39 of each respective screw 38 resides externally of upper rim 35 of canopy 14. A plurality of spaced apart indentations 40 are formed into upper rim 35 of canopy 14.

Figure 3:
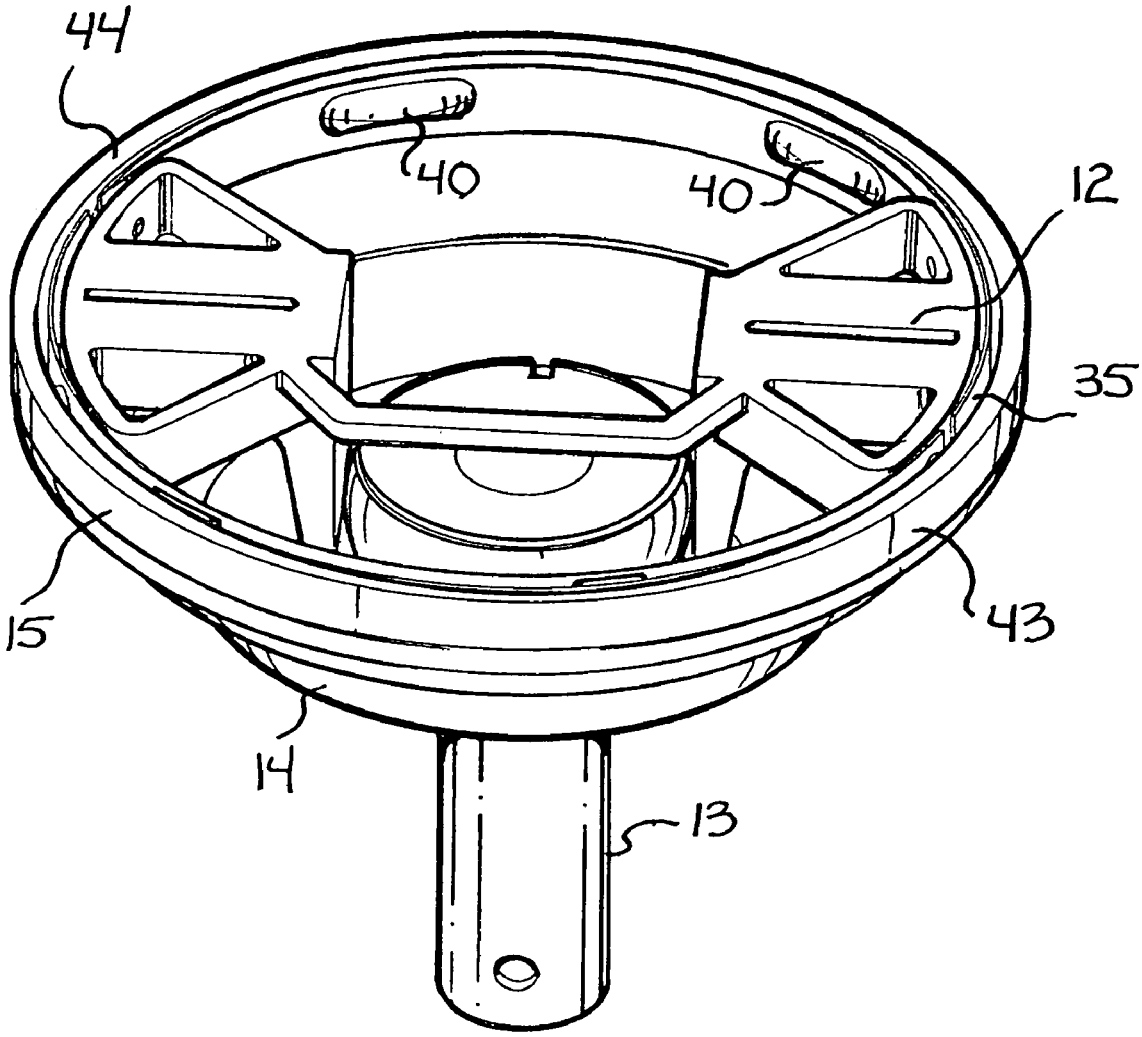
FIG. 3 is a perspective view of the hanger assembly of FIG. 1 as it would appear when fully assembled.
Figure 4:
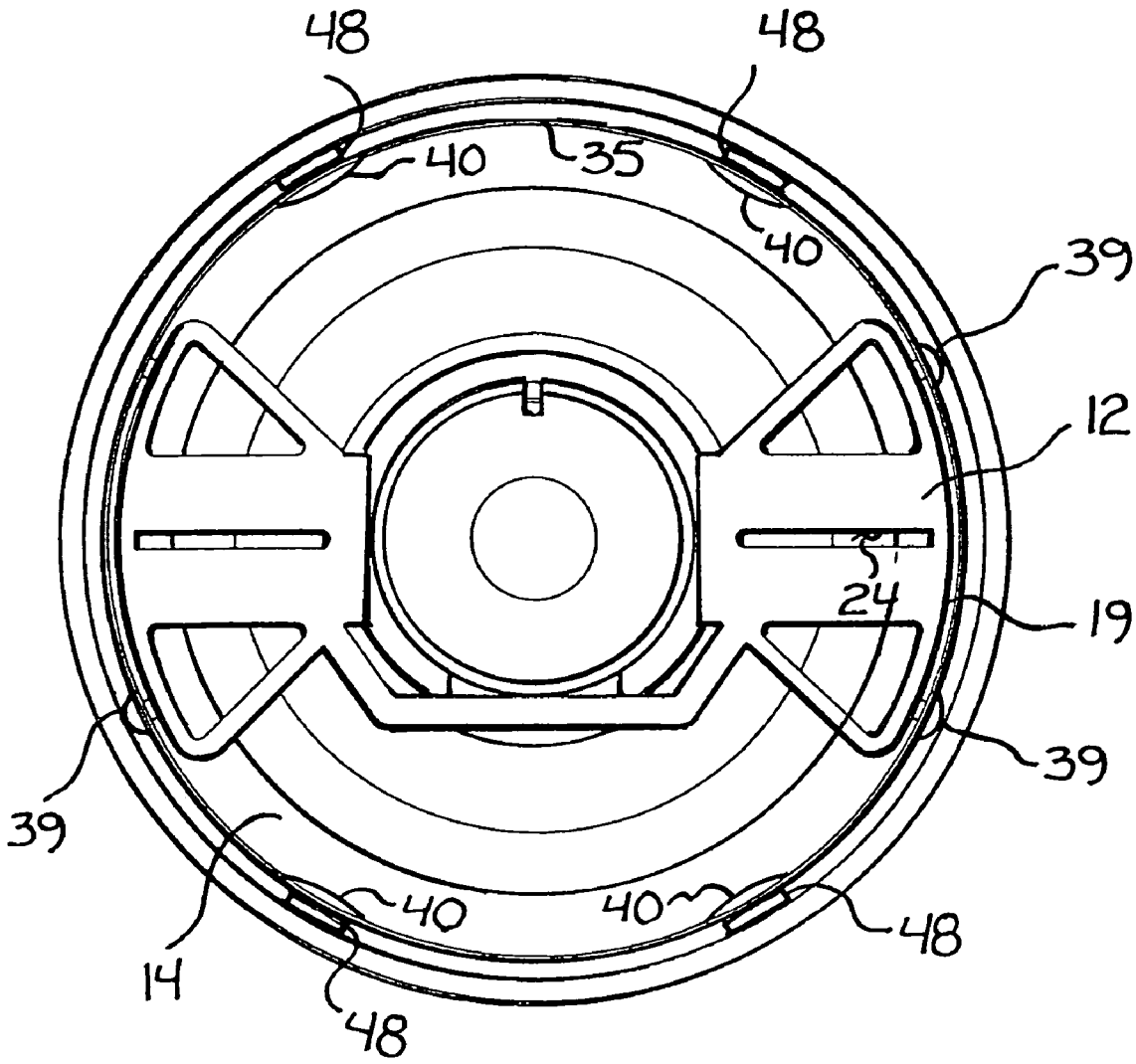
FIG. 4 is a top plan view of the assembly illustrated in FIG. 3.

Rim cover 15, illustrated in further detail in FIG. 3 and FIG. 4, includes sidewall 43 having upper edge 44 and lower edge 45 and which is sized to extend about and encapsulate heads 39 of screws 38. A plurality of protrusions 47 projects inwardly from sidewall 43. Preferably, the protrusions 47 are fabricated of a resilient material and each have a base 48 which is integrally formed with sidewall 43. The integral formation of sidewall 43 with bases 48 supporting protrusions 47 is preferred, but it will be understood that bases 48 can be welded to sidewall 43, adhesively affixed to sidewall 43, or rigidly affixed to sidewall 43 in other ways. Furthermore, protrusions 47 are each preferably integrally formed with its respective base 48. However, protrusions 47 can be welded to bases 48, adhesively affixed to bases 48, or rigidly affixed to bases 48 in other ways.

Figure 5:
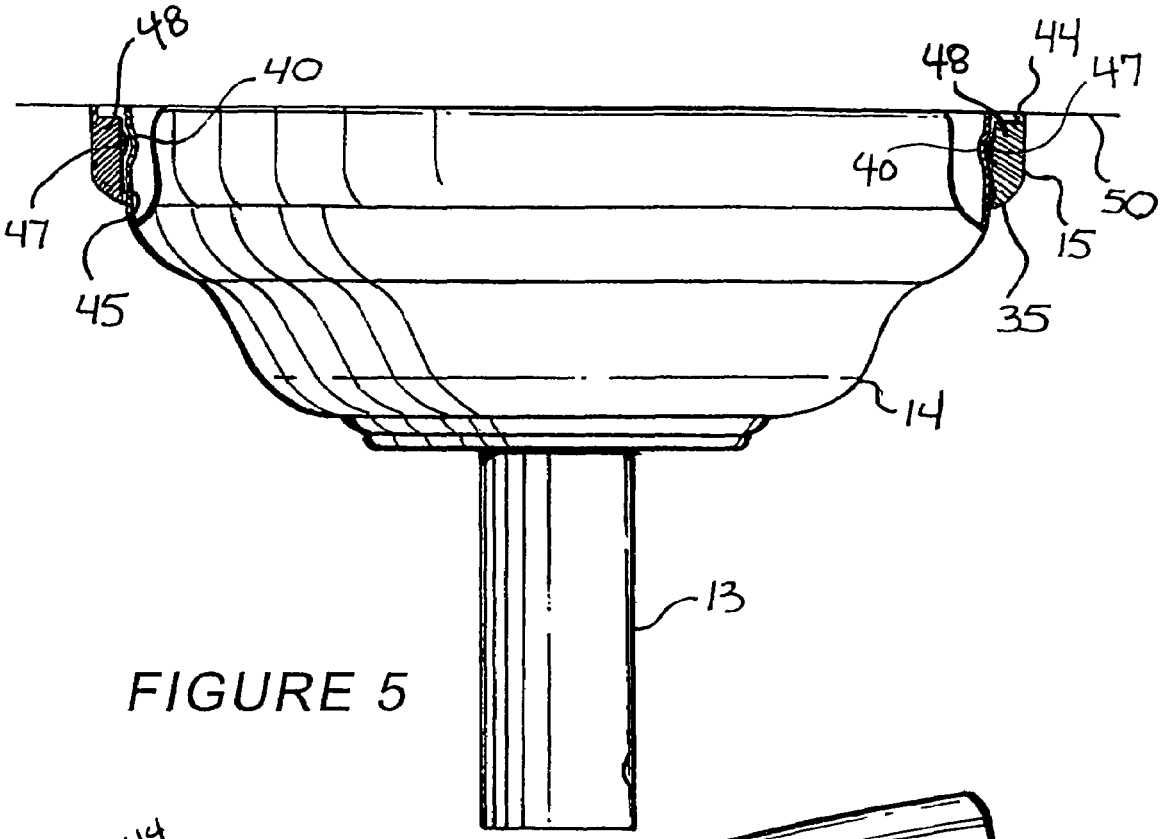
FIG. 5 is a side elevation view of the assembled hanger assembly of the instant invention.

Attention is now directed to FIG. 5, in which it seen that protrusions 47 reside within respective indentations 40 when the hanger assembly 10 is assembled and secured to an overhead support member. Indentations 40 function as an element of a detent engagement pair. Protrusions 47 function as a complemental element of the detent engagement pair. Accordingly rim cover 15 is received in snap engagement with canopy 14. Preferably, each indentation is circumferentially elongate thereby eliminating the necessity of precise alignment when fitting rim cover 15 about the upper rim 35 of canopy 14.

As further seen in FIG. 5, when the hanger assembly 10 is assembled and installed, the upper edge 44 of rim cover 15 resides in juxtaposition with ceiling 50. Lower edge 45 of rim cover 15 is in turned to reside in juxtaposition with canopy 14.

The present invention is described above with reference to a preferred embodiment. However, those skilled in the art will recognize that changes and modifications may be made in the described embodiment without departing from the nature and scope of the present invention. For instance, while the hanger assembly is illustrated as circular, it is contemplated that the assembly may assume a multi-sided or free form configuration. Furthermore, although protrusions 47 are attached to bases 48 which are integrally formed with sidewall 43, protrusions 47 can be mounted in place in other ways.

Figure 6:
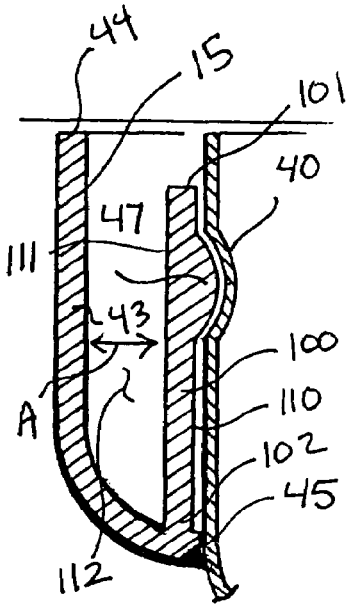
FIG. 6 is an enlarged vertical sectional view showing an embodiment of an engagement assembly for engaging a rim cover to a canopy of a ceiling fan hanger assembly.
Figure 7:
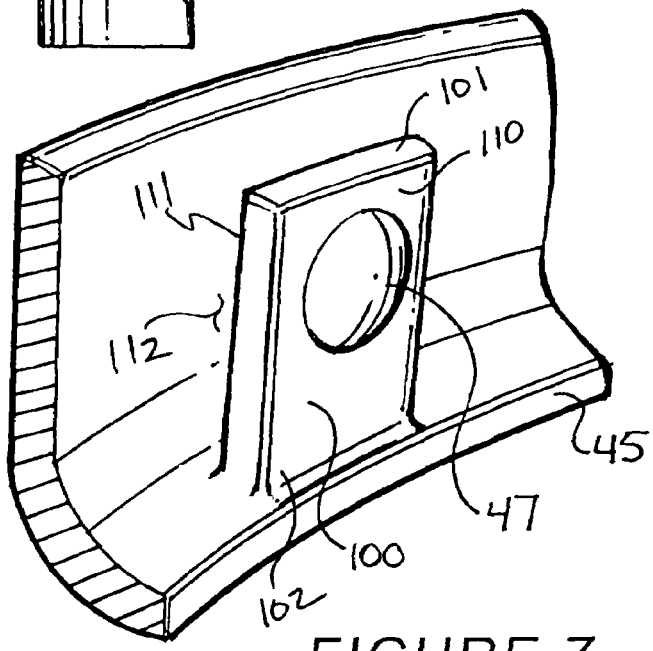
FIG. 7 is an enlarged perspective view showing an element of the engagement assembly of FIG. 6 carried by the rim cover.

For instance, FIGS. 6 and 7 show a protuberance carried by an upstanding finger 100 having an upper end 101 and an opposing lower end 102 affixed to sidewall 43 of rim cover 15 just inboard of lower edge 45. Finger 100 projects upwardly from lower edge 45 and terminates with upper end 101, which is directed toward upper edge 44. Finger 100 has a front face 110 to which protrusion 47 is attached, and an opposing rear face 111 facing sidewall 43, in which there is a gap 112 therebetween. Finger 100 is flexible, and flexes in reciprocal directions relative to sidewall as indicated by the double arrowed line A in FIG. 6. The flexural character of finger 100 allows it to flex as need for installing rim cover 15 to canopy 14 and removing rim cover 15 from canopy 14. FIG. 5 illustrates protrusion 47 as it would appear engaging indentation 40. The flexural nature of finger 100 is also provided in such a way that finger 100 biases protrusion 47 toward and against indentation 40 when installed therewith for providing a rugged and forcible engagement of protrusion 47 against indentation 40. Preferably, lower end 102 of finger 100 is integrally formed with sidewall 43. The integral formation of lower end 102 with sidewall 43 is preferred, but it will be understood that lower end 102 can be welded to sidewall 43, adhesively affixed to sidewall 43, or rigidly affixed to sidewall 43 in other ways. The protrusions of a rim cover constructed and arranged in accordance with the principle of the invention can each be constructed and arranged as herein disclosed in conjunction with FIGS. 6 and 7.

Various further changes and modifications to the embodiment herein chosen for purposes of illustration will readily occur to those skilled in the art. To the extent that such modifications and variations do not depart from the spirit of the invention, they are intended to be included within the scope thereof.

The invention claimed is:

1. A hanger assembly for depending a fan from an overheard support member, which support member is integral with a ceiling, said hanger assembly comprising:

a mounting bracket securable to said overhead support member and having a peripheral sidewall;

a down rod suspended from said mounting bracket and having a lower end engagable with said fan;

a canopy having a central opening for receiving said down rod there through and having an upper rim for receiving the sidewall of said mounting bracket therein;

a plurality of mounting screws, each of said screws extending through an opening in the rim of said canopy and engaged within the sidewall of said mounting bracket and having a head residing external of the rim of said canopy; and a rim cover for encapsulating the heads of said screws and securable to the rim of said canopy;

an element of a detent engagement pair carried by the rim of said canopy;

a complemental element of said detent engagement pair carried by said rim cover for detachable engagement with said element of said detent engagement pair;

one of said element and said complemental of said detent engagement pair comprising an indentation;

the other of said element and said complemental element of said engagement pair comprising a protrusion matingly receivable within said indentation;

a finger having a lower end affixed to the rim cover and an opposing upper end, a front face and an opposing rear face;

a gap between the rear face of the finger and the rim cover;

the finger flexurally resilient in reciprocal directions relative to the rim cover; and one of the indentation and the protrusion carried by the front face of the finger.

2. The hanger assembly of claim 1, wherein said protrusion is resilient.

3. The hanger assembly of claim 1, in which said indentation is circumferentially elongate.

4. The hanger assembly of claim 1, in which said rim cover includes an upper edge receivable in juxtaposition with said ceiling.

5. The hanger assembly of claim 1, in which said rim cover includes an in turned lower edge receivable in juxtaposition with said canopy.

* * * * *